US009429868B2

(12) United States Patent
Usui et al.

(10) Patent No.: US 9,429,868 B2
(45) Date of Patent: Aug. 30, 2016

(54) IMAGE FORMING APPARATUS

(71) Applicant: CANON KABUSHIKI KAISHA, Tokyo (JP)

(72) Inventors: Yusuke Usui, Tokyo (JP); Kuniaki Tamagaki, Kawasaki (JP); Akihisa Matsukawa, Fuchu (JP); Takashi Hiramatsu, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/821,916

(22) Filed: Aug. 10, 2015

(65) Prior Publication Data

US 2016/0054676 A1 Feb. 25, 2016

(30) Foreign Application Priority Data

Aug. 22, 2014 (JP) ..... 2014-169447

(51) Int. Cl.
*G03G 15/30* (2006.01)
*G03G 15/06* (2006.01)
(Continued)

(52) U.S. Cl.
CPC ..... *G03G 15/065* (2013.01); *G03G 15/0266* (2013.01); *G03G 15/095* (2013.01)

(58) Field of Classification Search
CPC ..... G03G 21/0064; G03G 2221/0005; G03G 15/0216; G03G 2215/021
USPC ..... 399/149
See application file for complete search history.

(56) References Cited

U.S. PATENT DOCUMENTS

2008/0131153 A1* 6/2008 Yoshikawa ..... G03G 15/0266 399/50
2008/0240758 A1* 10/2008 Shaw ..... G03G 15/0806 399/55

(Continued)

FOREIGN PATENT DOCUMENTS

JP S59-133573 A 7/1984
JP 3030188 B2 4/2000

(Continued)

OTHER PUBLICATIONS

Machine translation of Akira JP 2004-191766 A, publication date: Jul. 8, 2004.*

*Primary Examiner* — Walter L Lindsay, Jr.
*Assistant Examiner* — Frederick Wenderoth
(74) *Attorney, Agent, or Firm* — Fitzpatrick, Cella, Harper & Scinto

(57) ABSTRACT

An image forming apparatus includes a controller that executes a collection sequence to collect developer of opposite polarity adhering to a charging member. The controller executes the collection sequence by setting a first potential difference to allow the developer of opposite polarity to move from the charging member to an image bearing member, setting a second potential difference to allow the developer of opposite polarity to move from the image bearing member to a developer bearing member and to allow the developer of regular polarity to move from the developer bearing member to the image bearing member, setting a third potential difference to not allow the developer of regular polarity to move from the image bearing member to the charging member, and setting a fourth potential difference to allow the developer of regular polarity to move from the image bearing member to the developer bearing member.

15 Claims, 4 Drawing Sheets

(51) Int. Cl.
*G03G 15/02* (2006.01)
*G03G 15/095* (2006.01)

(56) References Cited

U.S. PATENT DOCUMENTS

2009/0067890 A1* 3/2009 Maeyama ..... G03G 15/0815 399/273
2013/0164011 A1* 6/2013 Nakamura ..... G03G 15/1675 399/66

FOREIGN PATENT DOCUMENTS

JP 2004-151368 A 5/2004
JP 2004-191766 A 7/2004

* cited by examiner

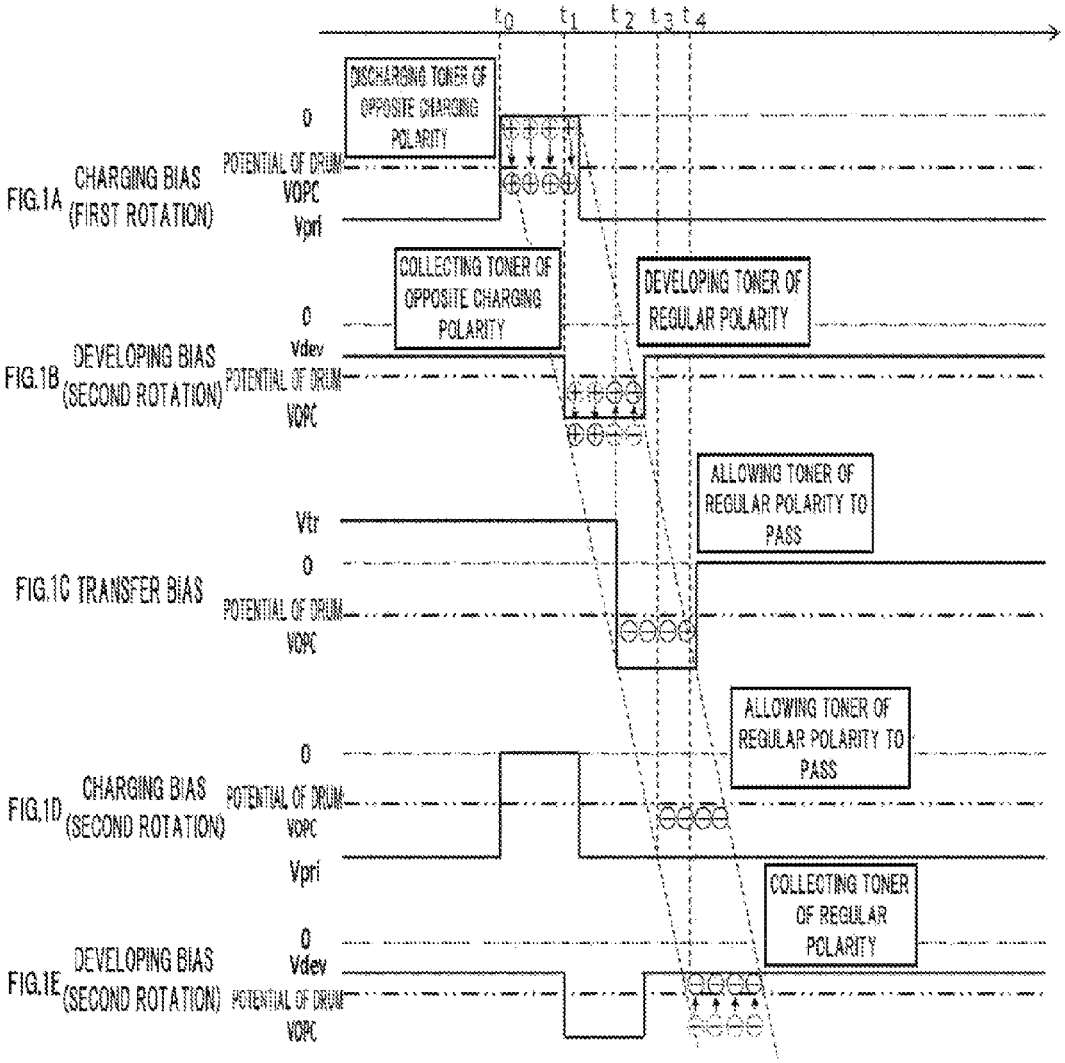
t0
t1
t2
t3
t4
DISCHARGING TONER OF OPPOSITE CHARGING POLARITY
0
POTENTIAL OF DRUM
VDPC
Vpri
FIG.1A CHARGING BIAS (FIRST ROTATION)
COLLECTING TONER OF OPPOSITE CHARGING POLARITY
DEVELOPING TONER OF REGULAR POLARITY
0
Vdev
POTENTIAL OF DRUM
VDPC
FIG.1B DEVELOPING BIAS (SECOND ROTATION)
ALLOWING TONER OF REGULAR POLARITY TO PASS
Vtr
0
POTENTIAL OF DRUM
VDPC
FIG.1C TRANSFER BIAS
ALLOWING TONER OF REGULAR POLARITY TO PASS
0
POTENTIAL OF DRUM
VDPC
Vpri
FIG.1D CHARGING BIAS (SECOND ROTATION)
COLLECTING TONER OF REGULAR POLARITY
0
Vdev
POTENTIAL OF DRUM
VDPC
FIG.1E DEVELOPING BIAS (SECOND ROTATION)

IMAGE FORMING APPARATUS

BACKGROUND OF THE INVENTION

1. Field of the Invention

The present invention relates to an image forming apparatus.

2. Description of the Related Art

An image forming apparatus using an electrophotographic system has a photosensitive drum, charging means, expo sure means, a developer bearing member, transfer means, cleaning means, and fixing means. The charging means charges the surface of the photosensitive drum uniformly (charging step). The exposure means exposes the charged photosensitive drum to the light, to form an electrostatic latent image (exposure step). The developer bearing member forms a toner image on the photosensitive drum as a developer image by supplying toner as developer to the electrostatic latent image (developing step). The transfer means transfers the toner image formed on the photosensitive drum to a transfer material such as a sheet of paper (transfer step). The cleaning means removes the residual toner remaining on the photosensitive drum after the transfer of the toner image (cleaning step). The fixing means fixes the toner image onto a recording material (fixing step).

Subsequent to the cleaning step, the photosensitive drum is subjected to the charging step again. In so doing, before subjected to the charging step again, the potential of the photosensitive drum obtained prior to the charging step is made uniform by pre-exposure means (pre-exposure step) to remove the unevenness in charge potential caused by a history of exposures in the exposure step. The photosensitive drum is subjected to an electrophotographic process while repeating the foregoing steps, and used for image formation.

The toner remaining on the photosensitive drum after the transfer step is removed from the surface of the photosensitive drum by the cleaning means and becomes waste toner, although waste toner is preferably not produced from the perspective of environmental protection, effective use of resources, reducing the size of the apparatus, and the like. There has been known a cleaner-less image forming apparatus in which the developer bearing member "develops and cleans simultaneously" to remove/collect the untransferred toner which used to be collected by the cleaning means, so that the removed/collected untransferred toner can be reused (Japanese Patent Application Publication No. S59-133573). The charging means may be a corona charging apparatus, a contact charging apparatus, and the like. From the perspective of the environment and reducing the size of the apparatus, the adoption of the contact DC charging system has been promoted in recent years.

Incidentally, the image forming apparatus employing the cleaner-less system might charge some of the toner to the opposite charging polarity, and this toner charged to the opposite charging polarity might adhere to the charging member which comes into contact with the photosensitive drum. The adhesion of the toner to the charging member is likely to have an impact on the charging capacity acting on the photosensitive drum.

For the purpose of preventing the adhesion of the toner to the charging member, the surface of the charging member is cleaned when the number of pages printed exceeds a predetermined number. According to Japanese Patent No. 3030188, once the number of pages printed reaches a multiple of 100, the transfer bias is turned off as the print job completes.

When the rear edge of the print area on the photosensitive drum passes through the position of the neutralization lamp, the neutralization lamp is turned off and the charging bias is turned off when the rear edge of the print area passes through the position of the charging roller functioning as the charging member. As a result, the toner of opposite charging polarity adhering to the charging roller shifts from the charging roller to adhere to the surface of the photosensitive drum. When, in this state, the toner of opposite charging polarity passes through the developing roller functioning as the developer bearing member, the toner of opposite charging polarity changes to toner of regular polarity by being rubbed by the developing roller that is applied with a bias lower than the surface potential of the photosensitive drum by an absolute value, and then the toner of regular polarity is collected by the developing roller. In this manner, the toner of opposite charging polarity is prevented from accumulating on the charging roller.

SUMMARY OF THE INVENTION

Nonetheless, as repeating the execution of image formation with the abovementioned simultaneous development/cleaning method, the toner deteriorates in the latter half of the life of a cartridge. And it might not be able to reverse the polarity of the toner successfully by means of the rubbing action between the developing roller and the photosensitive drum. In an another case where the polarity of the toner cannot be reversed successfully, the toner that is discharged from the charging roller to the photosensitive drum during the time of cleaning the charging roller is not collected by the developing roller functioning as the developer bearing member. As a result, the toner that is not collected by the developing roller adheres to the charging roller again, which possibly has an impact on charging of the photosensitive drum performed by the charging roller.

In view of the foregoing problems, the present invention aims to collect the developer using a developer bearing member without reversing the polarity of the developer by causing the rubbing action between the developer bearing member and the image bearing member.

An objection of the present invention is to provide an image forming apparatus for forming an image by transferring developer of regular polarity onto a transfer material, the image forming apparatus comprising:

an image bearing member capable of rotating;

a charging member that is provided in contact with the image bearing member and charges the image bearing member;

a developer bearing member that supplies developer to the image bearing member charged by the charging member; and a controller that executes a collection sequence in which the developer bearing member collects developer of opposite polarity adhering to the charging member, the opposite polarity being opposite to the regular polarity, wherein the controller executes the collection sequence by:

setting a first potential difference to allow the developer of opposite polarity to move from the charging member to the surface of the image bearing member;

setting a second potential difference to allow the developer of opposite polarity to move from the surface of the image bearing member to the developer bearing member and to allow the developer of regular polarity to move from the developer bearing member to the surface of the image bearing member when the surface of the image bearing member reaches a position facing the developer bearing member as a result of rotation of the image bearing member;

setting a third potential difference to not allow the developer of regular polarity to move from the surface of the image bearing member to the charging member when the surface of the image bearing member reaches again a position facing the charging member as a result of rotation of the image bearing member; and setting a fourth potential difference to allow the developer of regular polarity to move from the surface of the image bearing member to the developer bearing member when the surface of the image bearing member reaches again the position facing the developer bearing member as a result of rotation of the image bearing member.

The present invention can collect the developer by the developer bearing member without reversing the polarity of the developer by causing the rubbing action between the developer bearing member and the image bearing member.

Further features of the present invention will become apparent from the following description of exemplary embodiments (with reference to the attached drawings).

BRIEF DESCRIPTION OF THE DRAWINGS

FIGS. 1A to 1E are timing charts showing a collection sequence according to an example;

DESCRIPTION OF THE EMBODIMENTS

An embodiment for implementing the present invention is now exemplarily described hereinafter in detail based on the examples and with reference to the drawings. However, the sizes, materials, shapes and relative positions of the components described in the embodiment can be changed in accordance with the configuration of the apparatus and various conditions to which the present invention is applied. In other words, the scope of the present invention is not intended to be limited to the following embodiment.

<Image Forming Apparatus>

Figure 2:
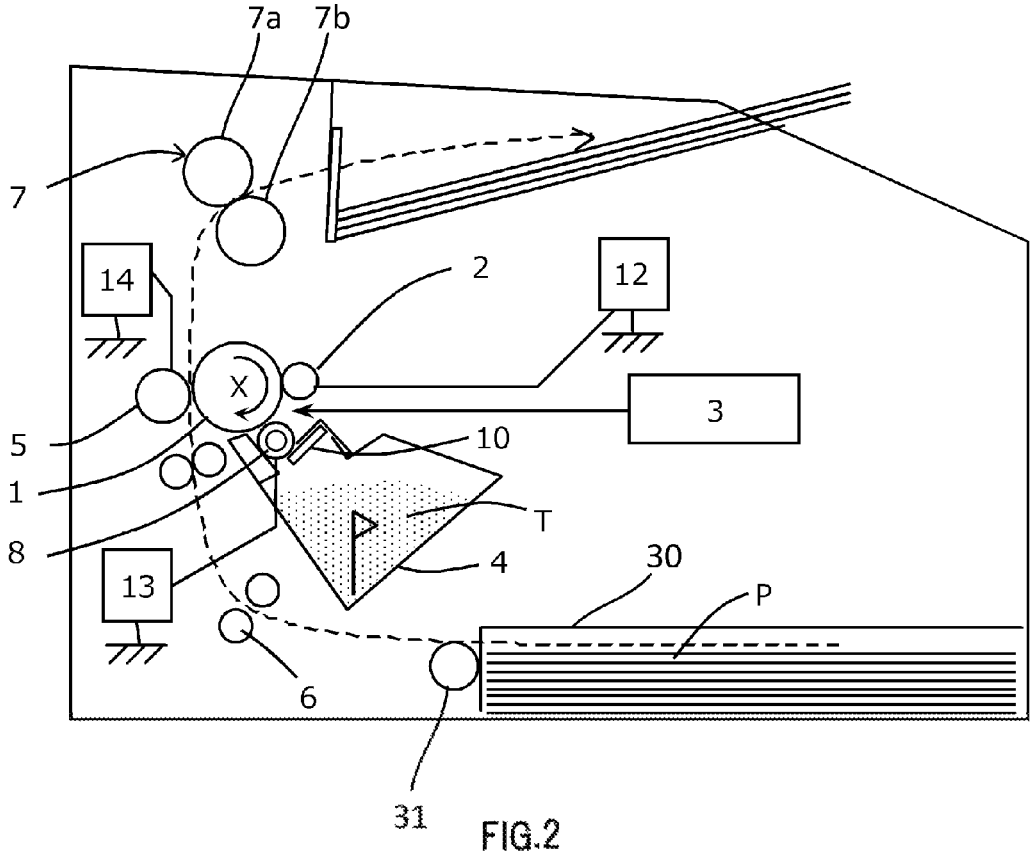
FIG. 2 is a schematic cross-sectional diagram showing a configuration of an image forming apparatus according to the example.

First of all, a configuration of an image forming apparatus according to an example of the present invention ("present example," hereinafter) is described schematically with reference to FIG. 2. FIG. 2 is a schematic cross-sectional diagram showing the configuration of the image forming apparatus according to the present example. The image forming apparatus according to the present example is a so-called "image forming apparatus with a simultaneous developing and cleaning system."

The image forming apparatus according to the present example is mainly configured with a photosensitive drum 1 functioning as a photoreceptor, a charging roller 2 functioning as a charging member, an exposure device 3 functioning as an exposure member, a developing device 4 having a developing roller (developing sleeve) 8 functioning as a developer bearing member, a transfer roller 5 functioning as a transfer member, and a fixing apparatus 7. The charging roller 2, capable of rotating, is applied with a bias by a charging bias power supply (charging bias application unit) 12, and thereby charges the surface of the photosensitive drum 1 uniformly to a predetermined potential. The exposure device 3 exposes the surface of the photosensitive drum 1 to the light based on latent image data, to form an electrostatic latent image on the photosensitive drum 1. The developing roller 8, capable of rotating, is applied with a bias by a developing bias power supply (developing bias application unit) 13, thereby develops the electrostatic latent image, and forms a toner image as a developer image on the photosensitive drum 1 (on the photoreceptor). The transfer roller 5, capable of rotating, is applied with a bias by a transfer bias power supply (transfer bias application unit) 14, and thereby transfers the toner image formed on the photosensitive drum 1 to a transfer material P such as a sheet of paper.

A paper cassette 30 capable of accommodating a large number of transfer materials P is provided in the lower part of the image forming apparatus, and the transfer materials P are fed one by one by means of a paper feed roller 31. The transfer materials P are each conveyed to resist rollers 6. The transfer materials P are then each conveyed to a transfer nip between the photosensitive drum and the transfer roller 5 where the toner image is transferred from the photosensitive drum 1 to each transfer material P. The transfer material P with the toner image is conveyed to a fixing nip between a fixing roller 7*a* and a pressure roller 7*b* of the fixing apparatus 7, and then the fixing apparatus fixes the toner image onto the transfer material P. After the toner image is fixed to the transfer material P, the transfer material P is discharged to the outside of the image forming apparatus through a discharging unit.

The timings of application of the biases by the foregoing charging bias power supply 12, developing bias power supply 13, and transfer bias power supply 14 are controlled by a controller (not shown) functioning as a control unit. The photosensitive drum 1, charging roller 2, transfer roller 5, fixing roller 7*a*, developing roller 8 and the like are rotated by transmission of power from a main motor (not shown) through gears or the like.

<Process Cartridge>

Figure 3:
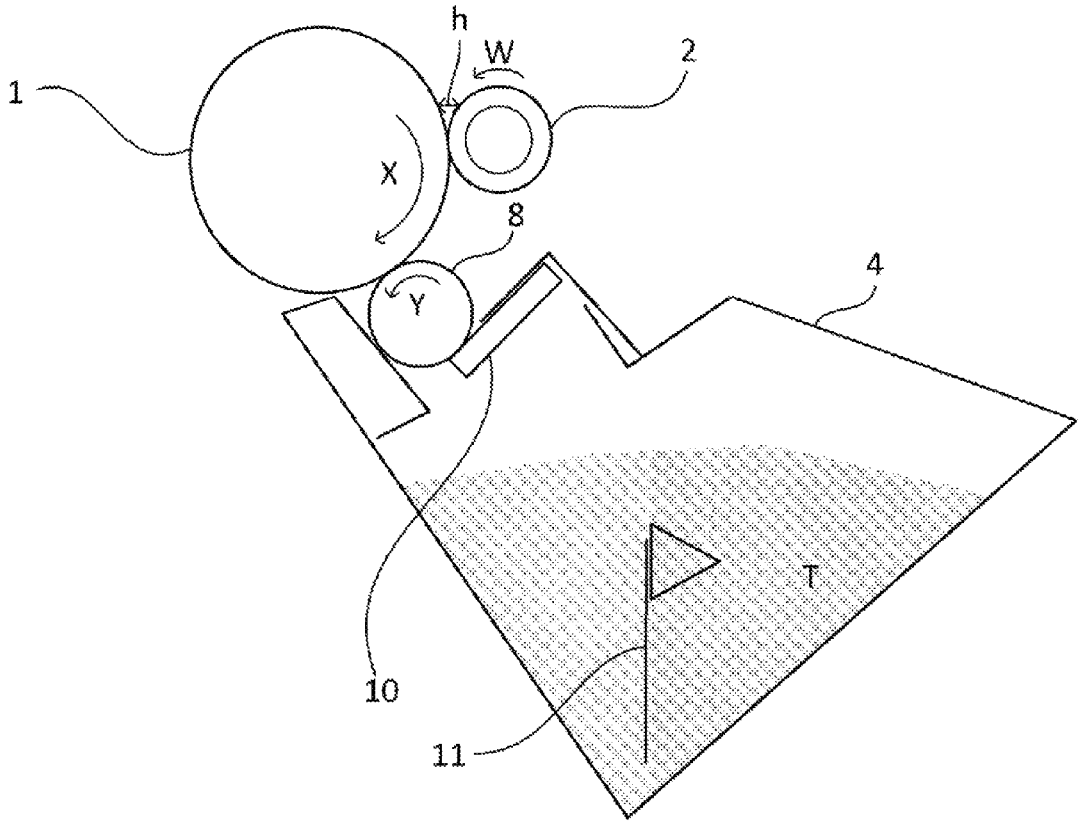
FIG. 3 is a schematic cross-sectional diagram showing a configuration of a process cartridge according to the example.

A process cartridge according to the present example is described next with reference to FIG. 3. FIG. 3 is a schematic cross-sectional diagram showing a configuration of the process cartridge according to the present example. The process cartridge is provided integrally with the image formation processing means such as the photosensitive drum 1, the charging roller 2, and the developing device 4. The process cartridge also is provided detachably to the main body of the image forming apparatus.

The photosensitive drum 1 is rotated by driving means, not shown, in the direction of the arrow X shown in FIG. 3 at a peripheral speed $V_X$. In the present example, the peripheral speed $V_X$ is 150 mm/sec. The diameter of the photosensitive drum 1 is 24 mm. The charging roller is a contact charging roller for charging the photosensitive drum 1 by coming into contact therewith. The charging roller is driven to rotate in the direction of the arrow W shown in FIG. 3 at the same speed as the photosensitive drum 1, and is applied with a charging bias (−1000 V), to uniformly charge the surface of the photosensitive drum 1 to approximately −500 V. The charging roller 2 used in the present example is obtained by forming a low-resistance conductive rubber layer having a volume resistivity of approximately $10^4$ Ωcm and a thickness of 1.5 mm on the outer circumferential surface of a 6-mm-diameter cored bar made of conductive metal, and then forming a high-resistance layer having a volume resistivity of approximately $10^8$ Ωcm and a thickness of 20 to 50 μm on the outer circumference of the conductive rubber layer. The charging roller 2 in the present example has a total diameter of 9 mm.

The developing device 4 has a developer container for containing magnetic toner (simply referred to as "toner,"

hereinafter) T. The developer container is provided with an opening at a section facing the photosensitive drum 1, and the developing roller 8 is disposed near the opening. The developing roller 8 comes into contact with the photosensitive drum 1, rotates in the direction of the arrow Y shown in FIG. 3 at a peripheral speed $V_Y$, and has a surface potential of −350 V at the time of image formation. The developing device 4 has a regulating blade 10 functioning as a toner regulating member and a stirring member 11 for stirring the toner T. The relationship between the peripheral speed $V_X$ of the photosensitive drum 1 and the peripheral speed $V_Y$ of the developing roller 8 is $V_X<V_Y$ (i.e., the peripheral speed of the developing roller 8 is higher than that of the photosensitive drum 1). The peripheral speed $V_Y$ of the developing roller 8 is set at 210 mm/sec.

Subsequently, the toner applied to the developing roller 8 is regulated in its amount by the regulating blade 10 and is triboelectrically charged by friction with the regulating blade 10. The regulating blade 10 is bent at a position approximately 2 mm away from the polyurethane rubber front edge in the direction opposite to the developing roller 8, the bent portion being disposed in contact with the developing roller 8 in such a manner as to cut into the developing roller 8. The toner that is charged by the regulating blade 10 and carried on the developing roller 8 is supplied to the photosensitive drum 1 by the developing bias (−350 V) and then the toner adheres to the electrostatic latent image, which is developed as a toner image. At the time of the image transfer, the transfer bias power supply 14 supplies a voltage of approximately +1.0 to 4.0 kV to the transfer roller 5 shown in FIG. 2.

<Contamination of the Charging Roller>

Next, the image forming apparatus described in the present example solves the contamination of the surface of the charging roller 2. Most of the toner image that is developed onto the photosensitive drum 1 is transferred to the transfer material P, but a small amount of untransferred toner that is not transferred to the transfer material P is present on the surface of the photosensitive drum 1. All the untransferred toner remaining on the photosensitive drum 1 after the transfer reaches the charging roller 2 as a result of the rotation of the photosensitive drum 1 in the direction of the arrow X. It receives the electrical discharge from the transfer roller, when the untransferred toner reaches the charging roller 2, the untransferred toner is charged to the opposite polarity (positive polarity) which is opposite to the regular polarity.

The untransferred toner that is charged to the opposite polarity (positive) which is opposite to the regular charging polarity (negative) is pulled toward the charging roller 2 by an electric field acting between the charging roller 2 and the photosensitive drum 1 and thereby adheres to the charging roller 2. The untransferred toner adhering to the charging roller 2 enters a discharge region h as a result of the rotation of the charging roller 2 in the direction of the arrow W. The discharge region h is located upstream of a charging nip between the photosensitive drum 1 and the charging roller 2 in the direction W of the rotation of the charging roller 2, between the photosensitive drum 1 and the charging roller 2, as shown in FIG. 3. A positive charge and a negative charge are generated in the discharge region h due to electrical discharge, and in a case of a negative-charge organic photosensitive drum used in the present example, the negative charge is pulled toward the photosensitive drum 1, contributing to charging the surface of the photosensitive drum 1. The positive charge that is generated simultaneously with the negative charge, on the other hand, is pulled toward the charging roller 2.

In the present embodiment, the charging polarity of the toner is negative but the charging polarity of the untransferred toner is positive, opposite to the negative polarity. Therefore, the untransferred toner present on the surface of the charging roller 2 is charged more positively by adhesion of the positive charge. Moreover, new untransferred toner that is conveyed by the rotation of the photosensitive drum 1 in the direction of the arrow X is deposited on the toner layer that has already adhered to the charging roller 2, and is consequently charged to the positive polarity by electrical discharge taking place in the vicinity of the charging roller 2, as described above. As soon as the toner adhering to the charging roller 2 is further charged strongly to the opposite polarity, the new untransferred toner is deposited on the charging roller 2. As a result, so-called "charging roller contamination" occurs in which multiple layers of toner are deposited on the charging roller 2. This prevents the photosensitive drum 1 from being charged to a normal surface potential, causing charging failure.

<Collection Sequence>

A toner discharge control sequence of the charging roller 2 and a toner collection control sequence of the developing roller 8 (these sequences are generically called "collection sequence," hereinafter), the characteristics of the present example, are described next with reference to FIGS. 1A to 1E and 4A to 4I. In the present example, the collection sequence is performed during the non-image formation process in which no images are formed. In the present example, the collection sequence is performed during the post-rotation of the photosensitive drum 1 after the passage of the transfer material, which corresponds to the non-image formation process.

FIGS. 1A to 1E are timing charts showing the collection sequence according to the present example. FIGS. 1A to 1E show controlling the charging bias, developing bias, and transfer bias. In FIG. 1A to 1E, the vertical axis represents the applied biases and the horizontal axis represents the times. The diagonal chain lines stretched across the charging, developing and transfer biases represent the same position on the photosensitive drum 1. The circles shown in FIGS. 1A to 1E represent the toner, and the "+" and "−" symbols in the circles represent the polarities of the toner. The dotted circles each indicate a state prior to a movement of the toner, and the solid circles each indicate a state after a movement of the toner.

In FIGS. 1A to 1E, time $t_0$ is a timing at which a portion of the surface of the photosensitive drum 1 passes through (the rear end of) the charging nip, in future the portion will come into contact with the rear edge of the transfer material P when the transfer material P passes through the transfer nip. Time $t_1$ is a timing at which a portion of the surface of the photosensitive drum 1 passes through (the rear end of) the developing nip, in the future the portion will come into contact with the rear edge of the transfer material P when the transfer material P passes through the transfer nip. Time $t_2$ is a timing at which a portion of the surface of the photosensitive drum 1 passes through (the rear of end) the transfer nip, in the future the portion will come into contact with the rear edge of the transfer material P when the transfer material P passes through the transfer nip. Time $t_3$ is a timing at which after a portion of the surface of the photosensitive drum 1 passes the charging nip and then comes into contact with the rear edge of the transfer material P passing through the transfer nip, the portion passes through (the rear end of) the charging nip again. Time $t_4$ is a timing at which after a portion of the surface of the photosensitive drum 1 passes the developing nip and then comes into contact with the rear edge of the transfer material P passing through the transfer nip, the portion passes through (the rear end of) the developing nip again.

Figures 4A, 4B, 4C, 4D, 4E, 4F, 4G, 4H, 4I:
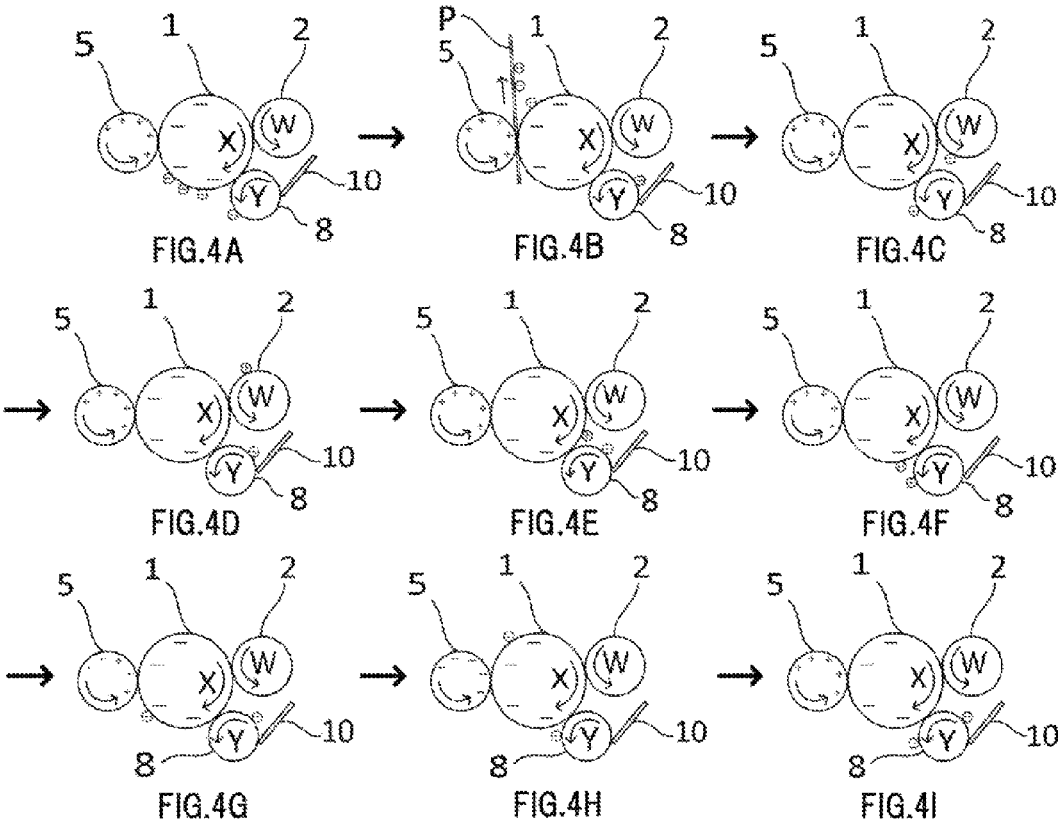
FIGS. 4A to 4I are schematic diagrams for explaining a movement of toner in the collection sequence according to the example.

FIGS. 4A to 4I are schematic diagrams for explaining a movement of the toner during the collection sequence according to the present example. FIG. 4A shows a state in which the toner of regular polarity (negative polarity) is supplied from the developing roller 8 to the photosensitive drum 1. FIG. 4B shows a state in which some of the toner of regular polarity (negative polarity) on the photosensitive drum 1 is transferred to the transfer material P, leaving the rest on the photosensitive drum 1. The polarity of the remaining toner is reversed to the opposite polarity (positive polarity) due to the transfer bias. FIG. 4C shows a state in which the toner of opposite polarity (positive polarity) that remains on the photosensitive drum 1 moves from the photosensitive drum 1 to the charging roller 2. FIG. 4D shows a state in which the toner of opposite polarity (positive polarity), which has moved to the charging roller 2, moves as the charging roller 2 rotates. FIG. 4E shows a state in which the toner of opposite polarity (positive polarity) moves from the charging roller 2 to the photosensitive drum 1. FIG. 4F shows a state in which the toner of opposite polarity (positive polarity), which has moved to the photosensitive drum 1, moves to the developing roller 8 and the toner of regular polarity (negative polarity) carried on the developing roller 8 moves to the photosensitive drum 1. FIG. 4G shows a state in which the toner of opposite polarity (positive polarity), which has moved to the developing roller 8, has its polarity reversed to the regular polarity (negative polarity) by the rubbing action between the developing roller 8 and the regulating blade 10. FIG. 4H shows a state in which the toner of regular polarity (negative polarity), which has moved to the photosensitive drum 1, passes through the transfer roller 5. FIG. 4I shows a state in which the toner of regular polarity (negative polarity) passes through the charging roller 2 and is collected by the developing roller 8.

First, in order to uniformly charge the surface potential of the photosensitive drum 1 to a dark potential (Vd) at time $t_0$, the photosensitive drum 1 is charged in advance by the charging roller 2 correspondingly to one rotation of the photosensitive drum 1. In the present example, the charging bias (Vpri) is −1000 V and the surface potential Vd of the photosensitive drum 1 at that time is −500 V.

Next, the charging bias (Vpri) that is applied to the charging roller 2 at time $t_0$ is controlled in such a manner that the difference $\Delta V_1$ between the charging bias (Vpri) and the surface potential (Vopc) of the photosensitive drum 1 allows the toner to move from the charging roller 2 to the photosensitive drum 1. In the present example, the relationship between the charging bias and the surface potential (Vopc) of the photosensitive drum 1 per rotation of the charging roller [$\Delta t_0 = t_3 - t_0$] is $|Vpri| < |Vopc|$. In other words, the absolute value of the charging bias is made smaller than that of the surface potential of the photosensitive drum 1. Accordingly, the toner of opposite polarity (positive polarity) adhering to the charging roller 2 moves electrically to the surface of the photosensitive drum 1. This state is shown in FIGS. 1A, 4D and 4E. The greater the difference between Vopc and Vpri, the greater the amount of toner transferred. In the present example, therefore, the charging bias at time $t_0$ (the first charging bias) is OFF (i.e., 0).

Next, the developing bias (VdeV) that is applied to the developing roller 8 at time $t_1$ is controlled in such a manner that the difference $\Delta V_2$ between the developing bias and the surface potential (Vopc) of the photosensitive drum 1 allows the toner to move from the photosensitive drum 1 to the developing roller 8. The toner moves from the photosensitive drum 1 to the developing roller 8 during the time period in which the part of the surface of the photosensitive drum 1 that comes into contact with the charging roller 2 at the time of the application of the first charging bias reaches and passes through the developing nip.

In the present example, the relationship between the developing bias (VdeV) and the surface potential of the photosensitive drum 1 per rotation of the charging roller $\Delta t_0$ is $|VdeV| > |Vopc|$. In other words, the absolute value of the developing bias is greater than that of the surface potential of the photosensitive drum 1. Accordingly, the toner of opposite polarity (positive polarity) that has been transferred from the charging roller 2 to the surface of the photosensitive drum 1 is electrically collected by the developing roller 8 without having its polarity changed. This state is shown in FIGS. 1B, 4E and 4F. The greater the difference between VdeV and Vopc, the better the amount of toner collected. However, when the difference exceeds a discharge starting potential, electrical discharge occurs between the developing roller 8 and the photosensitive drum 1. For this reason, the bias difference $\Delta_2$ is preferably equal to or less than the discharge starting voltage. In the present example, the developing bias (the first developing bias) at time $t_1$ is −750 V. The toner of regular polarity (negative polarity) moves from the developing roller 8 to the photosensitive drum 1 at the same time when the toner of opposite polarity (positive polarity) that has been transferred from the charging roller 2 to the photosensitive drum 1 is collected. This state is shown in FIGS. 1B, 4E and 4F.

Next, the transfer bias (Vtr) that is applied to the transfer roller 5 at time $t_2$ is controlled in such a manner that the difference $\Delta V_4$ between the transfer bias Vtr and the surface potential Vopc of the photosensitive drum 1 does not allow the toner to move from the photosensitive drum 1 to the transfer roller 5 (allows the toner to pass through the transfer roller 5). The toner on the photosensitive drum 1 does not move to the transfer roller 5 when the part of the surface of the photosensitive drum 1 that comes into contact with the developing roller 8 at the time of the application of the first developing bias reaches and passes through the transfer nip.

In the present example, the relationship between the transfer bias (Vtr) and the potential of the photosensitive drum per rotation of the charging roller $\Delta t_0$ is $|Vtr| > |Vopc|$. Accordingly, the toner of regular polarity (negative polarity) remains on the surface of the photosensitive drum 1 without being transferred to the transfer roller 5. This state is shown in FIG. 1C, FIG. 4G and FIG. 4H. In the present example, the transfer bias at time $t_2$ (predetermined transfer bias) is −1000 V. In other words, the absolute value of the transfer bias is greater than that of the surface potential of the photosensitive drum 1.

Similarly, the charging bias (Vpri) that is applied to the charging roller 2 at time $t_3$ is controlled in such a manner that the difference between the surface potential of the photosensitive drum 1 and the charging bias does not allow the toner to move from the photosensitive drum 1 to the charging roller 2 (allows the toner to pass through the charging roller 2). The toner on the photosensitive drum 1 does not move to the charging roller 2 when the part of the surface of the photosensitive drum 1 that comes into contact with the transfer roller 5 at the time of the application of the predetermined transfer bias reaches and passes through the charging nip.

In the present example, the relationship between the charging bias (Vpri) and the potential of the photosensitive drum per rotation of the charging roller $\Delta t_0$ is $|Vpri| > |Vopc|$. In other words, the absolute value of the charging bias is greater than that of the surface potential of the photosensitive drum 1. Accordingly, the toner of regular polarity (negative polarity) that remains on the surface of the photosensitive drum 1 without being transferred to the charging roller 2 remains on the surface of the photosensitive drum 1 without being collected by the charging roller 2. This state is shown in FIGS. 1D, 4H and 4I. In the present example, the charging bias at time $t_3$ (the second charging device) is −1000 V.

Next, the developing bias (VdeV) that is applied to the developing roller 8 at time $t_4$ is controlled in such a manner that the difference $\Delta V_3$ between the developing bias (VdeV) and the surface potential (Vopc) of the photosensitive drum 1 allows the toner to move from the photosensitive drum 1 to the developing roller 8. The toner on the photosensitive drum 1 moves to the developing roller 8 when the part of the surface of the photosensitive drum 1 that comes into contact with the developing roller 8 at the time of the application of the first developing bias reaches and passes through the developing nip again.

In the present example, the relationship between the developing bias and the surface potential of the photosensitive drum per rotation of the charging roller $\Delta t_0$ is $|VdeV|<|Vopc|$. In other words, the absolute value of the developing bias is smaller than that of the surface potential of the photosensitive drum 1. Accordingly, the toner of regular polarity (negative polarity) that remains on the surface of the photosensitive drum 1 is collected electrically by the developing roller 8. This state is shown in FIGS. 1E and 4I. The greater the difference between VdeV and Vopc, the better the amount of toner collected. However, the greater the difference becomes, the more easily the reverse fogging occurs especially in the latter half of the life of the cartridge. For this reason, in the present example the developing bias at time $t_4$ (the second developing bias) is −350 V.

<Comparison between the Present Example and the Prior Art>

The relationship between the impact of the charging roller contamination on an image and the number of transfer materials P fed is described next by comparing the present example with the prior art. Note that the prior art used a method for reversing the toner polarity by means of the rubbing action between the untransferred toner and the developing roller 8 and causing the developing roller 8 to collect the untransferred toner.

TABLE 1

| | Number of transfer materials fed | | | | | |
|---|---|---|---|---|---|---|
| | 1000 Pages | 2000 Pages | 3000 Pages | 4000 Pages | 5000 Pages | 10000 Pages |
| Prior Art | ○ | ○ | ○ | X | X | X |
| Present Example | ○ | ○ | ○ | ○ | ○ | ○ |

In the prior art, an impact of the charging roller contamination on an image has occurred when the number of transfer materials P fed was 3000 to 4000. This phenomenon indicates that, in a situation where the toner deteriorates as the number of transfer materials fed increases, the polarity of the toner that is discharged from the charging roller 2 to the photosensitive drum 1 for the reason of cleaning the charging roller 2 could not be reversed by means of the rubbing action of the developing roller 8, and consequently the toner could not be collected completely by the developing roller 8.

However, in the configuration using the present example, there was no impact of the charging roller contamination on an image even after 10,000 transfer materials P were fed. This phenomenon indicates that, even in a situation in which the toner deteriorates as the number of transfer materials fed increases, the toner that is discharged from the charging roller 2 to the photosensitive drum 1 for the reason of cleaning the charging roller 2 was collected by the developing roller 8.

According to the present example, although the collection sequence is performed during the post-rotation after feeding the transfer materials, the present invention is not limited to this example. For instance, an output counter may be provided and the collection sequence may be performed every predetermined number of transfer materials. According to the present example, the toner is discharged from the charging roller 2 correspondingly to one rotation of the charging roller; however, the present invention is not limited to this example. In addition, although the present example has described the contact charging roller, the present invention is not limited to this example. For instance, the present invention can be applied to a charging device of any shape such as a brush charging device.

Moreover, the present example is described above with an example in which the regular polarity of the toner is the negative polarity, the values of the charging bias and the developing bias are negative (less than 0), and the value of the transfer bias is positive (greater than 0). However, the present invention is not limited to this example. In other words, the regular polarity of the toner may be the positive polarity, the values of the charging bias and the developing bias may be positive (greater than 0), and the value of the transfer bias may be negative (less than 0). In either case, it is preferred that the absolute value of the first charging bias be smaller than that of the surface potential of the photosensitive drum and that the absolute value of the second charging bias be greater than that of the surface potential of the photosensitive drum. It is also preferred that the absolute value of the first developing bias be greater than that of the surface potential of the photosensitive drum and that the absolute value of the second developing bias be smaller than that of the surface potential of the photosensitive drum. It is also preferred that the absolute value of the predetermined transfer bias be greater than that of the surface potential of the photosensitive drum.

According to the present example as described above, at the time of non-image formation, the untransferred toner of opposite polarity adhering to the charging roller 2 is transferred to the surface of the photosensitive drum 1 by setting the absolute value of the charging bias applied to the charging roller to be smaller than that of the surface potential of the photosensitive drum 1. Next, the untransferred toner discharged from the charging roller 2 to the surface of the photosensitive drum 1 is collected by setting the absolute value of the developing bias applied to the developing roller 8 to be greater than that of the surface potential of the photosensitive drum 1. The toner of regular polarity (negative polarity) that is developed onto the photosensitive drum 1 at the same time when the untransferred toner is collected is allowed to pass through the transfer roller 5 and the charging roller 2 by setting the absolute values of the transfer bias and the charging bias applied to the transfer roller 5 and the charging roller 2 to be greater than the absolute value of the surface potential of the photosensitive drum 1. The toner of regular polarity is collected by the developing roller 8 by setting the absolute value of the developing bias applied to the developing roller 8 in the end to be lower than that of the surface potential of the photosensitive drum 1.

According to this configuration, even in a situation where the toner deteriorates in the latter half of the life of the cartridge, the untransferred toner adhering to the charging roller 2 can be removed stably because the toner can be developed and collected without having its polarity reversed, lowering the impact of charging failure on an image.

(Other Configurations)

A monochrome image forming apparatus was described above. However, the present invention can be applied to an image forming apparatus that has a plurality of process cartridges in each of which the photosensitive drum functioning as an image bearing member is integrated with the developing assembly. The processes cartridges in this case are detachably attached to the main body of the image forming apparatus. The present invention can also be implemented in a configuration in which a plurality of developing assemblies (or a plurality of developer bearing members) are provided in a single photosensitive drum, although control of such image forming apparatus is complicated.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-169447, filed Aug. 22, 2014, which is hereby incorporated by reference herein in its entirety.

What is claimed is:

1. An image forming apparatus for forming an image by transferring developer of regular polarity onto a transfer material, the image forming apparatus comprising:

an image bearing member;

a charging member that is provided in contact with the image bearing member and charges the image bearing member;

a developer bearing member that supplies developer to the image bearing member charged by the charging member; and a controller that executes a collection sequence in which the developer bearing member collects developer of opposite polarity adhering to the charging member, the opposite polarity being opposite to the regular polarity, wherein the controller executes the collection sequence by:

setting a first potential difference to allow the developer of opposite polarity to move from the charging member to the surface of the image bearing member;

setting a second potential difference to allow the developer of opposite polarity to move from the surface of the image bearing member to the developer bearing member and to allow the developer of regular polarity to move from the developer bearing member to the surface of the image bearing member when the surface of the image bearing member reaches a position facing the developer bearing member as a result of rotation of the image bearing member;

setting a third potential difference to not allow the developer of regular polarity to move from the surface of the image bearing member to the charging member when the surface of the image bearing member reaches again a position facing the charging member as a result of rotation of the image bearing member; and setting a fourth potential difference to allow the developer of regular polarity to move from the surface of the image bearing member to the developer bearing member when the surface of the image bearing member reaches again the position facing the developer bearing member as a result of rotation of the image bearing member.

2. The image forming apparatus according to claim 1, wherein the collection sequence is executed after image formation and at the time of non-image formation in which no images are formed.

3. The image forming apparatus according to claim 1, further comprising:

a transfer member for transferring, to the transfer material, the developer that is supplied by the developer bearing member to the image bearing member, wherein a fifth potential difference is set to not allow the developer of regular polarity to move from the surface of the image bearing member to the transfer member when the surface of the image bearing member reaches again a position facing the transfer member as a result of rotation of the image bearing member.

4. The image forming apparatus according to claim 3, wherein the fifth potential difference is a difference between a transfer bias applied to the transfer member and a surface potential of the image bearing member.

5. The image forming apparatus according to claim 1, wherein the first potential difference is a difference between a charging bias applied to the charging member and a surface potential of the image bearing member.

6. The image forming apparatus according to claim 1, wherein the second potential difference is a difference between a developing bias applied to the developer bearing member and a surface potential of the image bearing member.

7. The image forming apparatus according to claim 1, wherein the third potential difference is a difference between a charging bias applied to the charging member and a surface potential of the image bearing member.

8. The image forming apparatus according to claim 1, wherein the fourth potential difference is a difference between a developing bias applied to the developer bearing member and a surface potential of the image bearing member.

9. The image forming apparatus according to claim 1, wherein an absolute value of a charging bias applied to the charging member at which the difference between the charging bias and a surface potential of the image bearing member is the first potential difference is smaller than an absolute value of the surface potential of the image bearing member, an absolute value of a developing bias applied to the developer bearing member at which the difference between the developing bias and the surface potential of the image bearing member is the second potential difference is greater than the absolute value of the surface potential of the image bearing member, and an absolute value of the developing bias applied to the developer bearing member at which the difference between the developing bias and the surface potential of the image bearing member is the fourth potential difference is smaller than the absolute value of the surface potential of the image bearing member.

10. The image forming apparatus according to claim 3, wherein a value of a transfer bias applied to the transfer member at which the difference between the transfer bias and a surface potential of the image bearing member is the fifth potential difference is greater than an absolute value of the surface potential of the image bearing member.

11. The image forming apparatus according to claim 1, wherein the developer is magnetic toner.

12. The image forming apparatus according to claim 1, wherein the controller sets the potential differences in the following order: the first potential difference, the second potential difference, the third potential difference, the fourth potential difference.

13. The image forming apparatus according to claim 1, wherein a cleaner-less system is employed.

14. An image forming apparatus for forming an image by transferring developer of regular polarity onto a transfer material, the image forming apparatus comprising:

an image bearing member;

a charging member that is provided in contact with the image bearing member and charges the image bearing member;

a developer bearing member that supplies developer to the image bearing member charged by the charging member; and a controller that executes a collection sequence in which the developer bearing member collects developer of opposite polarity adhering to the charging member, the opposite polarity being opposite to the regular polarity, wherein the collection sequence includes a first sequence and a second sequence, the controller executes the first sequence by:

setting a first potential difference to allow the developer of opposite polarity to move from the charging member to the surface of the image bearing member;

setting a second potential difference to allow the developer of opposite polarity, which moves from the charging member to the surface of the image bearing member by the first potential difference, to move from the surface of the image bearing member to the developer bearing member when the surface of the image bearing member reaches a position facing the developer bearing member as a result of rotation of the image bearing member;

the controller executes the second sequence by:

setting a third potential difference to not allow the developer of regular polarity, which moves from the developer bearing member to the surface of the image bearing member by the second potential difference, to move from the surface of the image bearing member to the charging member when the surface of the image bearing member reaches again a position facing the charging member as a result of rotation of the image bearing member; and setting a fourth potential difference to allow the developer of regular polarity, which moves from the developer bearing member to the surface of the image bearing member by the second potential difference, to move from the surface of the image bearing member to the developer bearing member after passing through a position facing the charging member and when the surface of the image bearing member reaches again the position facing the developer bearing member as a result of rotation of the image bearing member.

15. An image forming apparatus for forming an image by transferring developer of regular polarity onto a transfer material, the image forming apparatus comprising:

an image bearing member;

a charging member that is provided in contact with the image bearing member and charges the image bearing member;

a developer bearing member that supplies developer to the image bearing member charged by the charging member; and a controller that executes a first collection sequence in which the developer bearing member collects developer of opposite polarity adhering to the charging member, the opposite polarity being opposite to the regular polarity, wherein the controller executes a second collection sequence in which the developer bearing member collects the developer of regular polarity which moves from the developer bearing member to the surface of the image bearing member when the developer of opposite polarity moves from the surface of the image bearing member to the developer bearing member in the first collection sequence; and in the second collection sequence, the controller sets a potential difference such that the developer of regular polarity, which moves from the developer bearing member to the surface of the image bearing member, moves from the surface of the image bearing member to the developer bearing member without moving to the charging member.

* * * * *